United States Patent [19]

Rolando

[11] 4,195,362

[45] Apr. 1, 1980

[54] SHOCK RESISTANT JACKET

[75] Inventor: Pierluigi Rolando, Vicolungoa, Italy

[73] Assignee: Maglificio Biellese Fratelli Fila S.p.A., Italy

[21] Appl. No.: 915,409

[22] Filed: Jun. 14, 1978

[30] Foreign Application Priority Data

Nov. 15, 1977 [IT] Italy ..... 22720/77[U]

[51] Int. Cl.[2] ..... A41D 13/00; A41D 1/02

[52] U.S. Cl. ..... 2/2; 2/2.5; 2/97; 2/108

[58] Field of Search ..... 2/2.5, 108, 97, 98, 2/93, 2, 79

[56] References Cited

U.S. PATENT DOCUMENTS

| | | | |
|---|---|---|---|
| 1,169,256 | 1/1916 | Grimm et al. | 2/108 |
| 2,417,271 | 3/1947 | Snyder | 2/98 X |
| 3,116,489 | 1/1964 | Weiss | 2/97 |
| 3,500,472 | 3/1970 | Castellani | 2/2.5 |
| 3,514,786 | 6/1970 | Terwilliger | 2/2.5 |

FOREIGN PATENT DOCUMENTS

| | | | |
|---|---|---|---|
| 2059046 | 8/1971 | Fed. Rep. of Germany | 2/79 |
| 2205283 | 5/1974 | France | 2/108 |
| 2256729 | 8/1975 | France | 2/79 |
| 2309115 | 11/1976 | France | 2/108 |

*Primary Examiner*—H. Hampton Hunter

*Attorney, Agent, or Firm*—Steinberg and Blake

[57] ABSTRACT

An insulated jacket, such as of the ski jacket type, which provides absorption of impact shock which may be incurred by the wearer during participation in sports, such as skiing. A plurality of plate assemblies are associated with the body and sleeve forming portions of the jacket, each of the plate assemblies including a resilient support member and at least one rigid plate member.

13 Claims, 8 Drawing Figures

SHOCK RESISTANT JACKET

BACKGROUND OF THE INVENTION

This invention relates generally to outer wear apparel and, more particularly, to insulated jackets, such as of the ski jacket type.

The construction of insulated jackets for use during cold weather outdoor activities, such as sports activities, is well known. For example, insulated jackets for use by skiers, commonly known as ski jackets, are well known.

It is not uncommon for such sports activities to involve severe physical contact. For example, in slalom skiing, where a downhill skier attempts to traverse a path between gates defined by upstanding poles, it is not uncommon for a skier to impact against such poles at high speeds which not only impairs the skier's performance, but which also may cause severe muscular pain thereafter.

In the past, in view of the fact that the skier required utmost flexibility while skiing as well as the lightest load from his clothing for increased performance, the ski jackets heretofore known have not provided any significant resistance to the shock impacts referred to hereinabove. Thus, the required lightness and flexibility of currently known ski jackets have precluded the provision of meaningful resistance to shock impact.

SUMMARY OF THE INVENTION

Accordingly, one object of the present invention is to provide a new and improved insulated jacket which provides resistance against the shock of impact.

Another object of the present invention is to provide a new and improved shock resistant insulated jacket which retains the flexibility and lightness of conventional jackets.

Still another object of the present invention is to provide a new and improved insulated jacket of the ski jacket type particularly suitable for use by slalom skiers by providing resistance against impact shock in the shoulder and arm areas.

Briefly, these and other objects are attained by providing an insulated jacket, such as of the ski jacket type, comprising a body forming portion having an upper shoulder forming portion and having a pair of sleeve forming portions fixed to the respective sides thereof. A plurality of shock absorbing or resistant plate assemblies are associated with one or both of the body and sleeve forming portions, each of the plate assemblies including a resilient support member and at least one rigid plate member. A plurality of plate members may be associated with a single resilient support member to preserve the required flexibility. The localized shock of the impact is distributed by the rigid plate member over the surface of the resilient support member which absorbs the shock and further distributes it against the wearer's body thereby further lessening the transmitted shock.

DESCRIPTION OF THE DRAWINGS

A more complete appreciation of the invention and many of the attendant advantages thereof will be readily appreciated as the same becomes better understood by reference to the following detailed description when considered in connection with the accompanying drawings in which.

DESCRIPTION OF THE PREFERRED EMBODIMENT

Figure 1:
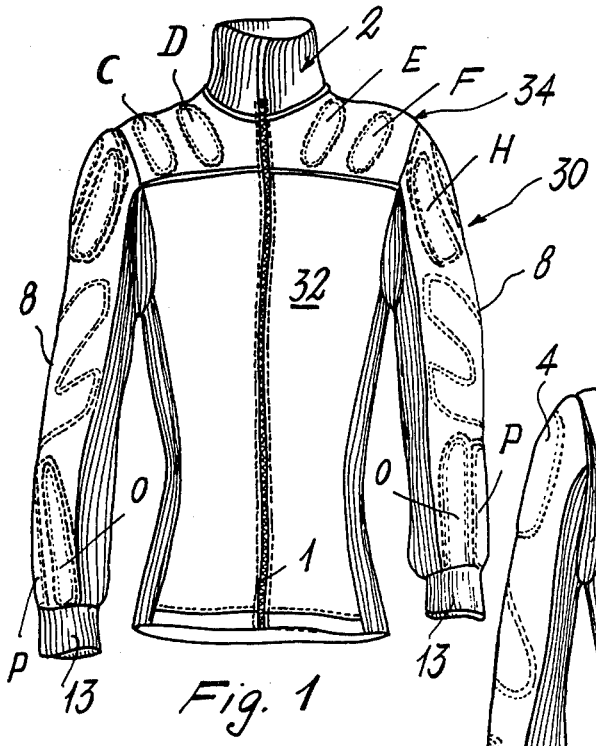
FIG. 1 is a front elevation view of the insulated jacket of the present invention.
Figure 2:
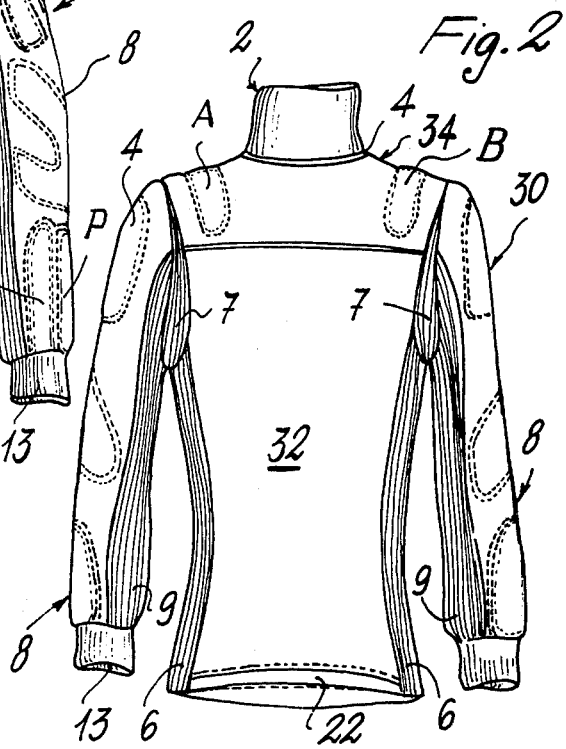
FIG. 2 is a rear elevation view of the insulated jacket of the present invention.

Referring now to the drawings wherein like reference characters designate identical or corresponding parts throughout the several views, the insulated jacket of the present invention, generally denoted as 30, includes a body forming portion 32 and a pair of sleeve forming portions 8 fixed to the upper or shoulder forming portion 34 of body forming body portion 32. A slide fastener or zipper 1 is provided along the front of body forming portion 32 as is conventional. Similarly, conventional wool cuff portions 13 are affixed to the free end of sleeve forming portions 8 preferably having a rib stitch. Other conventional accoutrements may be provided, such as an elastic strip 22 on the bottom edge of body forming portion 32 of the jacket.

Figure 4:
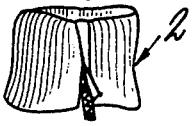
FIGS. 4, 5, and 6 are front elevation views of a jacket collar for use in connection with the present invention.
Figure 5:
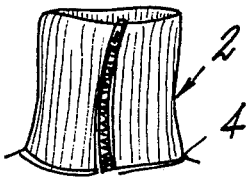
Figure 6:
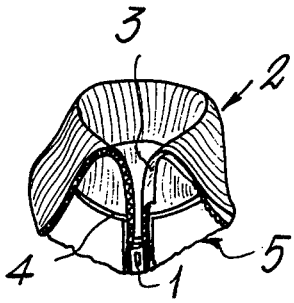

Referring particularly to FIGS. 4 through 6, a ribbed elastic turnable collar 2 is provided, the zipper 1 (FIG. 6) extending upwardly beyond the body forming portion to the collar 2 to open or close the collar as desired. In order to prevent the zipper from coming into contact with the wearer, an extension flap 3 is provided on one of the edges of the collar adjacent zipper 1 which, when the collar is turned, is interposed between the wearer's skin and the zipper.

It is often desirable to provide insulation and wind proofing protection in certain areas of the jacket beyond that normally afforded by the construction of the jacket. In this connection, the body forming portion 32 of jacket 30 is provided with a pair of bands 6 extending longitudinally from the lower edge to a point where the sleeve forming portion is affixed to the body forming portion. A pair of similar bands 9 longitudinally extend along the inner portion of the sleeve forming portions 8 and, additionally, jointed inserts 7 are provided at the joint between the body and sleeve forming portions 32, 8 bridging the two portions. Bands 6 and 9 and insert 7 may be formed of pure wool, a wool blend material or a synthetic material having a rib stitch and further may be lined on the inner sides by a bielastic stitch fabric of polyamide fiber and lycra. The outer surfaces of bands 6 and 9 and insert 7 preferably have a rough texture to provide antislide properties.

Figure 7:
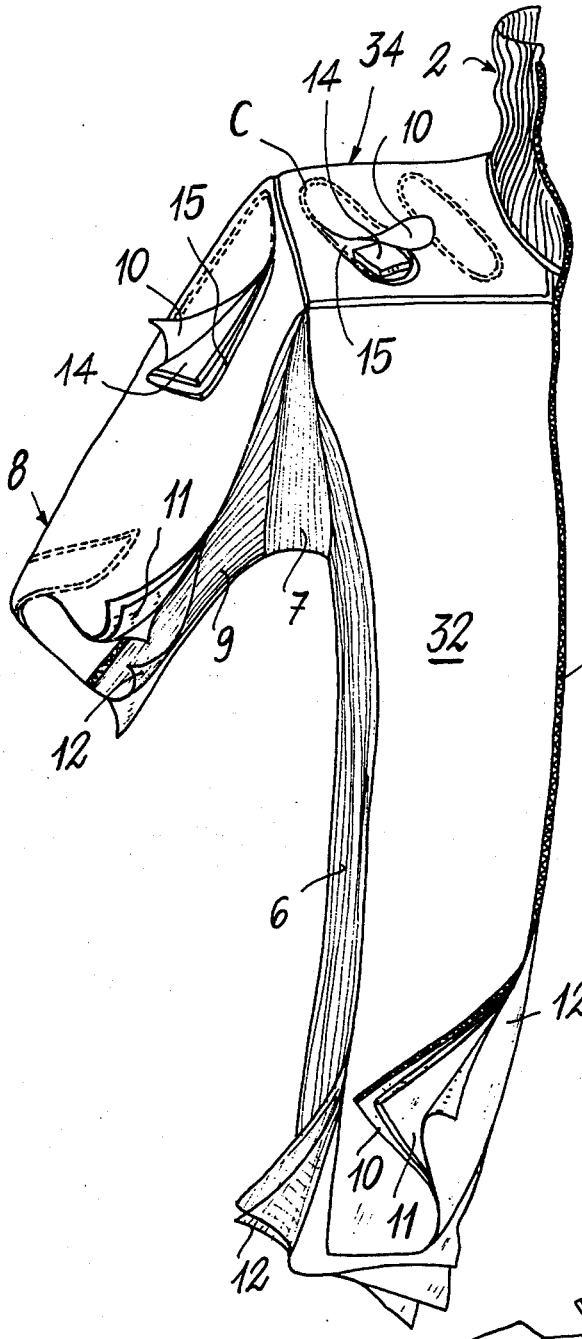
FIG. 7 is a partial front elevation view of the jacket of the present invention illustrating the various layers in a separated or fanned condition.

Referring to FIG. 7, the body and sleeve forming portions 32, 8 of jacket 30 comprise a three layered construction, namely an outer layer 10 of a windproof fabric, an inner layer 12 comprising a fabric liner, preferably of a slippery nature which will promote the movement of the wearer's body or limbs inside of the jacket, and an intermediate layer 11 of highly insulating foam material, preferably affixed to the inner layer 12 of the jacket.

Outer layer 10 preferably comprises a thick filling nylon and cotton fabric having a bidirectional elasticity and which has a slight roughness to provide antisliding properties. Intermediate layer 11 in the preferred embodiment comprises a closed cell foamed polyurethane with a high insulation capacity. The intermediate layer 11 is preferably integrally affixed, such for example as by gluing, to inner layer 12 which in the preferred embodiment preferably comprises an elastic fabric of nylon stitch which acts as a protective lining and further allows good slipping to promote the body movements of the wearer.

In accordance with the present invention, the jacket is provided with plate assemblies in several distinct areas where it has been found that a skier occasionally inadvertently impacts against the post or gate on a slalom trail. However, it is understood that the placement of the plate assemblies depends upon the particular sport or other use in which the wearer is engaged and it is within the scope of the present invention to provide such plate assemblies in areas other than as shown in the drawings.

Thus, according to the preferred embodiment, plate assemblies are provided in the shoulder forming portion 34 and sleeve forming portions 8 of jacket 30. The plate assemblies generally comprise a support member 15 formed of a resilient material, such for example as synthetic or natural rubber foam or semirigid foamed polyurethane, and one or more plate members 14 formed of a rigid material, such for example as polyvinylchloride. The plate members 14 are affixed to the resilient support members 15 by conventional means, such as adhesive. Generally, where the plate assemblies are located in areas corresponding to areas of the wearer's body which require maximum flexibility, the plate assemblies comprise a plurality of plate members affixed to a single resilient support member, thereby providing a plate assembly having relatively good flexibility.

Figure 8:
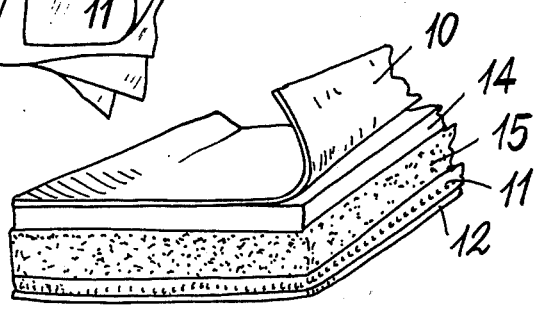
FIG. 8 is a perspective view of a cross section of the jacket of the present invention at a location wherein a plate assembly is provided.

The plate assemblies are sewn into the jacket and are located between the outer layer 10 and intermediate insulating layer 11, as best seen in FIG. 8. The plate assemblies are laterally bordered by seams sewn around the perimeter of the resilient supporting member 15.

Referring now to the particular embodiment illustrated in the drawings, two plate assemblies A, B, and four plate assemblies C, D, E and F are provided on the back and front respectively of shoulder forming portion 34. Each of the plate assemblies A through F preferably comprise two plate members 14 affixed to a single resilient support member 15 having an oval contour as shown. Referring to FIG. 7, one of the two plate members 14 is shown affixed to resilient support member 15 of plate assembly C. As shown, outer layer 10 is sewn over the plate assembly.

Figure 3:
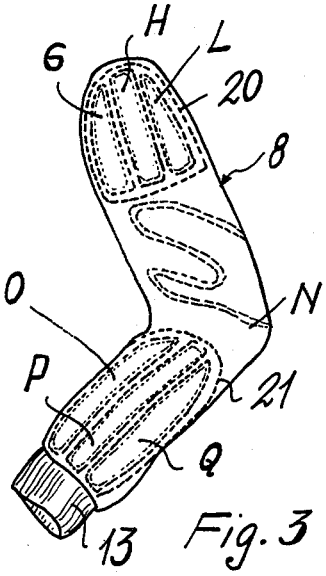
FIG. 3 is a side view of the sleeve forming portion of the present invention.

Referring to FIG. 3, three longitudinally juxtaposed plate assemblies G, H, and L are provided on each sleeve forming portion 8 at the level of the scapular muscle. Each of these plate assemblies comprise a single plate on a resilient support. Alternatively, a single plate assembly may be provided comprising three plate members affixed on a common resilient support.

Still referring to FIG. 3, a substantially V-shaped plate assembly N is provided at the elbow area. Plate assembly N comprises three plates mounted on a common resilient support.

Still referring to FIG. 3, the forearm area of arm forming portion 8 is provided with three longitudinal plate assemblies O, P and Q, each of which comprises a plate member affixed on a support member. Alternatively, a single plate assembly may be provided comprising a common resilient support member and three separate plate members affixed thereto. In all cases, the boundries of the resilient support member extend to the outer seam. Thus, in the case of plate assemblies G, H, and L, the outer boundary of the resilient support member extends to seam 20 while in the case of plate assemblies O, P, and Q, the boundries of the resilient support member extend to seam 21.

Thus, it may be seen that upon the wearer impacting against an object, for example, against plate assembly C, the shock of the impact will be resisted and absorbed by the plate members 14 comprising a part thereof which will also distribute the shock to the resilient support member 15 which further distributes and diminishes the extent of the impact shock.

Obviously, numerous modifications and variations of the present invention are possible in the light of the above teachings. For example, plate assemblies having different shapes and located in different areas than as shown may be employed. Various types of collars, cuffs and windproofing bands may be provided or not, as desired. It is therefore to be understood that within the scope of the appended claims the invention may be practiced otherwise than as specifically described herein.

What is claimed is:

1. An insulated protective jacket, such as of the ski jacket type, comprising:

a body forming portion defined by inner and outer fabric layers at least one of which is substantially windproof and an intermediate layer disposed between said inner and outer layers formed of a thermally insulating material, said body forming portion including a shoulder forming portion at an upper region thereof;

a pair of sleeve forming portions attached to said body forming portion defined by inner and outer fabric layers at least one of which is substantially windproof and an intermediate layer disposed between said inner and outer layers formed of a thermally insulating material; and a plurality of protective plate assemblies provided only within each of said shoulder and sleeve forming portions between one of said outer and inner fabric layers and said intermediate insulating layer, each of said plate assemblies including a substantially rigid plate membe and a substantially resilient support member; said plate member resting on an associated support member which is interposed between said plate member and said inner fabric layer.

2. An insulated jcket as recited in claim 1 wherein said plate member is formed of polyvinylchloride.

3. An insulated jacket as recited in claim 1 wherein said support member is formed of a rubber foam material.

4. And insulated jacket as recited in claim 1 wherein said support member is formed of semirigid foamed polyurethane.

5. An insulated jacket as recited in claim 1 wherein said outer fabric layer comprises a windproof elastic fabric layer of nylon and cotton fabric, said intermediate layer is formed of foamed polyurethane and said inner layer is formed of a relatively slippery elastic fabric.

6. An insulated jacket as recited in claim 1 wherein the sides of said body forming portion and sleeve forming portions are provided with elongate inserts formed of elastic fabric longitudinally extending thereover.

7. An insulated jacket as recited in claim 6 wherein said inserts are formed of a wool material.

8. An insulated jacket as recited in claim 6 wherein said inserts are formed of a synthetic rib stitch fabric.

9. An insulated jacket as recited in claim 1 further including an elastic turnable collar formed of a wool material including a sliding fastener.

10. An insulated jacket as recited in claim 1 wherein the plate assemblies located in the shoulder forming portions include a plurality of oval shaped plate assemblies, each plate assembly comprising a support member and at least two plate members resting thereon.

11. An insulated jacket as recited in claim 1 wherein the plate assemblies located in the sleeve forming portion include a plate assembly located substantially at the level of the scapular muscle of the wearer, said plate assembly including a support member and a plurality of plate members resting thereon.

12. An insulated jacket as recited in claim 11 wherein one of the plate assemblies located in the sleeve forming portion comprises a substantially V-shaped plate assembly located at the elbow area of the sleeve forming portion.

13. An insulated protective jacket as defined in claim 1 wherein said plate assemblies are provided between said outer fabric lining and said intermediate layer such that the latter backs against said resilient support member on the side thereof opposite from the side on which said plate member rests.

* * * * *